United States Patent [19]

Higgins

[11] Patent Number: 4,606,358

[45] Date of Patent: Aug. 19, 1986

[54] COLLAR

[76] Inventor: Brian J. Higgins, Bay Beach, New South Wales, Australia, 2300

[21] Appl. No.: 576,702

[22] Filed: Feb. 3, 1984

[30] Foreign Application Priority Data

Sep. 6, 1983 [AU] Australia ..... PG1251

[51] Int. Cl.[4] ..... A24D 1/04

[52] U.S. Cl. ..... 132/9; 132/1 R

[58] Field of Search ..... 132/1 R, 9; 2/50, 49, 2/48, 174; 128/75, 132 R, 132 D

[56] References Cited

U.S. PATENT DOCUMENTS

| | | | |
|---|---|---|---|
| 1,556,468 | 10/1925 | Alamo . | |
| 1,977,769 | 10/1934 | Levy | 4/159 |
| 2,093,483 | 9/1937 | Sackett | 2/50 |
| 2,116,685 | 5/1938 | Nicolet | 2/50 |
| 2,357,461 | 9/1944 | Ellinger | 4/159 |
| 2,804,624 | 9/1957 | Schattel | 2/49 |
| 2,965,903 | 12/1960 | Nodurft | 2/50 |
| 3,055,358 | 9/1962 | Di Palma et al. | 128/75 |
| 3,164,151 | 1/1965 | Nicoll | 128/75 |
| 3,512,523 | 5/1970 | Barnett | 128/75 |
| 3,765,412 | 10/1973 | Ommaya et al. | 128/132 |
| 3,863,343 | 2/1975 | Malmin | 32/1 |
| 4,231,119 | 11/1980 | Quinn | 2/48 |
| 4,419,774 | 12/1983 | Hajek | 4/516 |

*Primary Examiner*—Robert Peshock
*Assistant Examiner*—C. W. Shedd
*Attorney, Agent, or Firm*—McDougall, Hersh & Scott

[57] ABSTRACT

This invention concerns hair salon accessories and especially devices for assisting in customer comfort while the hair is wetted.

13 Claims, 6 Drawing Figures

COLLAR

BACKGROUND OF THE INVENTION

Some treatments of the hair involve lengthy procedures and substantial periods spent with the hair submerged in water in the salon wash basin while hair is washed, examined and rinsed. Wetting the hair in the wash basin might occur more than once in a particular hair treatment, and each time the customer's skin and clothes must be protected adequately. It is usual to provide this protection by copious use of towels placed on the neck and in the shoulder region. This leads to expensive laundering and drying moreover the very absorbency of the towels tends to transfer moisture to the customer's clothes sooner or later. Occasionally the use of towelling allows water to run down the customer's neck leading to wet underclothes.

SUMMARY OF THE INVENTION

This invention provides a seal for positioning between a person's neck, and the concave region of a salon neck tray which tray is profiled to accommodate a person's neck, such seal comprising a collar having (a) a water proof flexible outer layer of sheet material which at least partially surrounds (b) a cushioning inner layer capable of being compressed by the wearer between the wearer's neck and the concave region of the salon neck tray in order to act as a water barrier where the collar contacts the wearer and (c) means to fix the seal in an operative position.

DESCRIPTION OF THE DRAWINGS

A preferred embodiment of the invention is now described with reference to the accompanying drawings in which.

DETAILED DESCRIPTION

Figure 1:
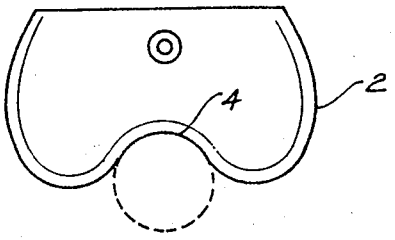
FIG. 1 is a plan of a salon tray showing the position of the person's neck for washing the hair.
Figure 2:
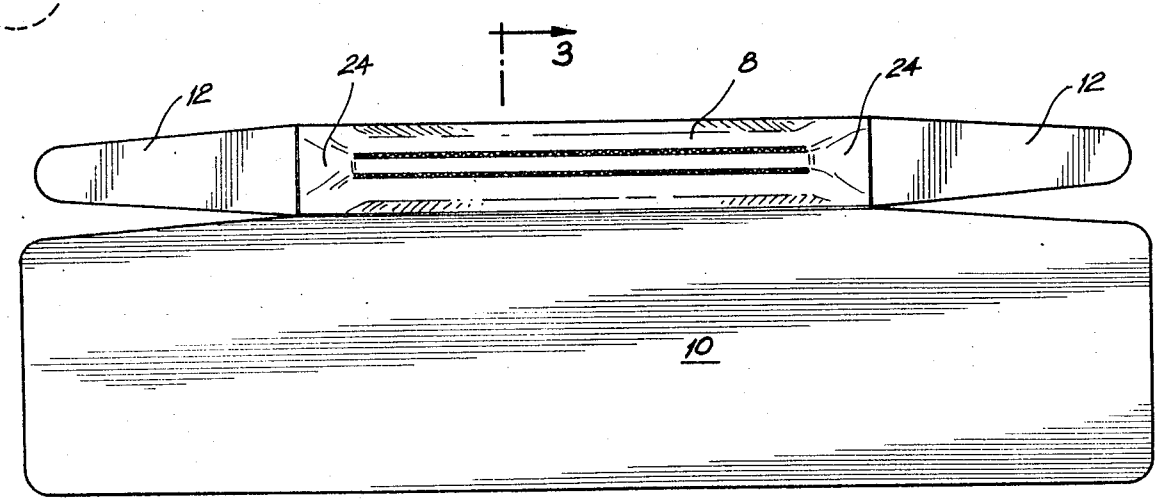
FIG. 2 is a rear view of the garment with the cape extended.
Figure 4:
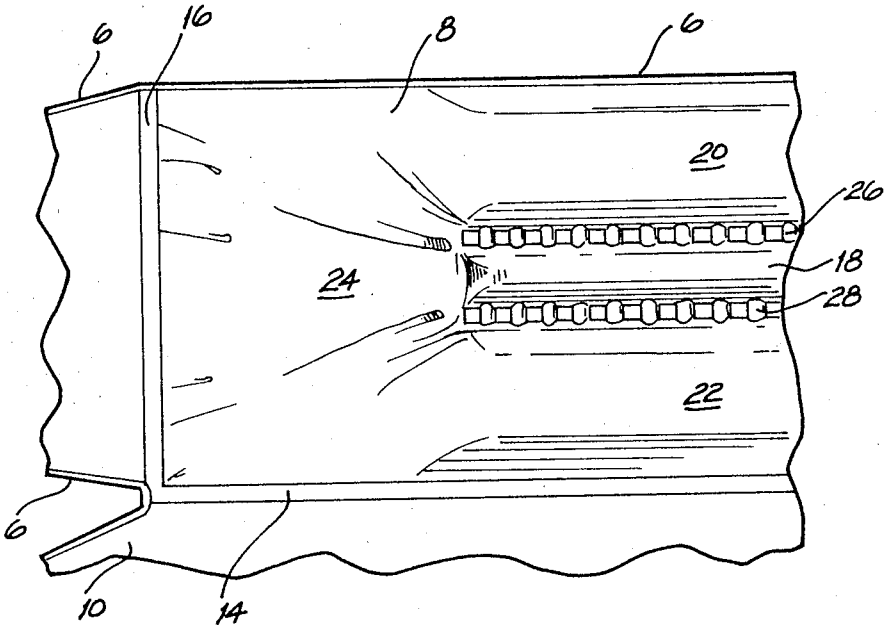
FIG. 4 is a fragment of the collar on a larger scale showing the constructional detail.
Figure 3:
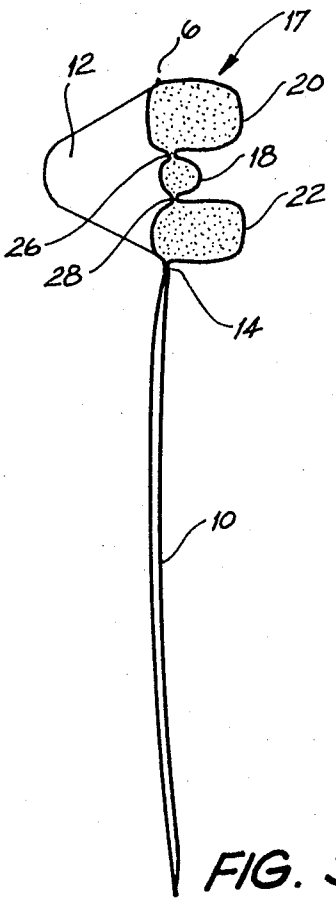
FIG. 3 is a section on the line 3—3 of FIG. 2.
Figure 5:
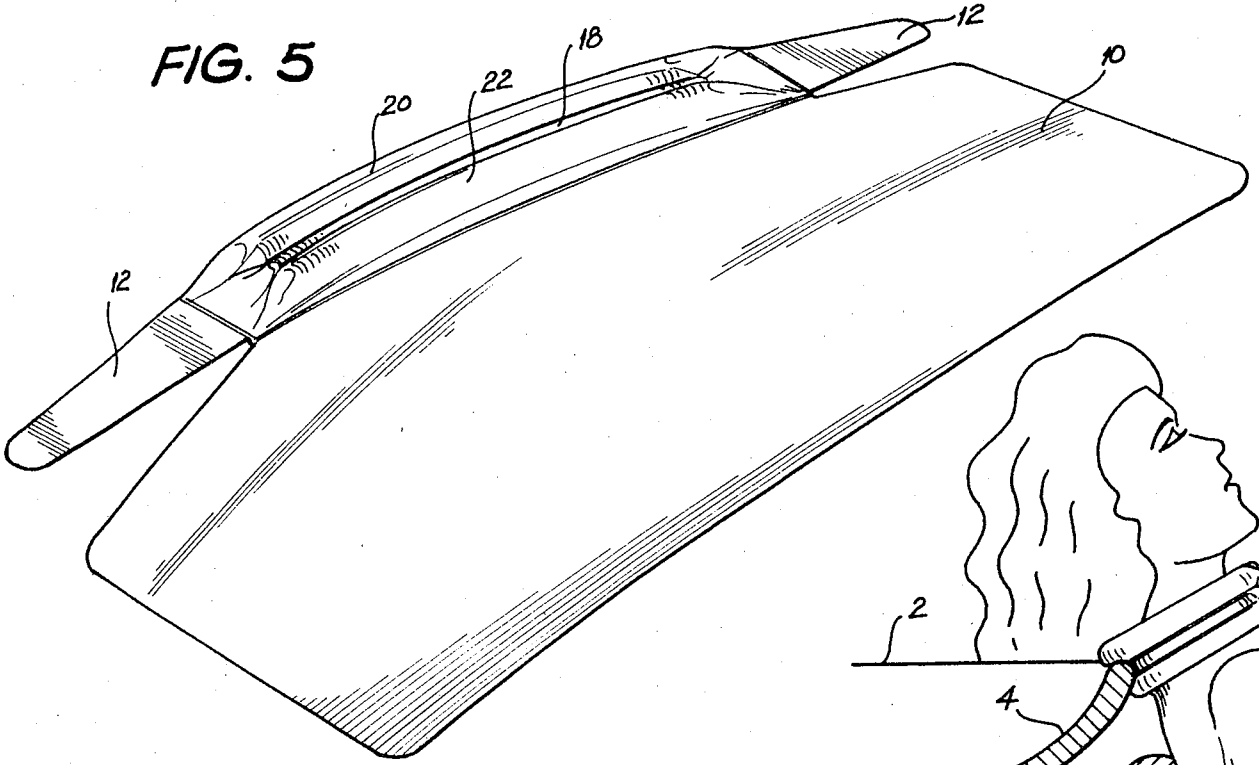
FIG. 5 is a perspective view of the garment.
Figure 6:
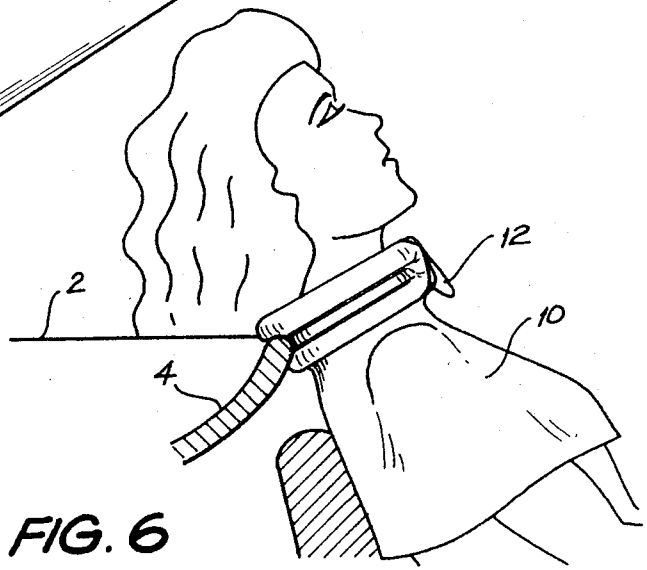
FIG. 6 is a diagram of the garment in use with a fragment of the tray shown in section.

Referring now to FIG. 1 the ceramic salon tray 2 has a profiled portion 4 which receives the neck of the person whose hair is to be washed.

Referring now to FIGS. 2 to 5, the garment is made from a pair of polyvinyl chloride sheet plies 1 which are joined by a perimeter weld 6 so that the finished garment is of double sheet thickness. The garment consists of a collar 8, a cape 10 extending from the collar in a direction which will cover the upper back and shoulders of the wearer and a pair of ties 12 extending one from each end of the collar for retaining the garment in position.

The collar 8 is a tube closed by peripheral weld 6, cape weld 14 and end welds 16 (one only shown). The tube contains a preformed, polyether cushion 17 (see FIG. 3) with a groove 18 in the face which will be directed to the rear in the finished collar. The groove 18 defines an upper rib 20 and a lower rib 22. The ends 24 of the cushion are tapered so as to be accommodated beneath the chin of the wearer without undue bulk.

The plies are secured around the cushion by an upper weld line 26 and a lower weld line 28. This structure allows flexibility in the collar and the portion 30 of the cushion between the weld lines groove provides sufficient resilience to render contact with the tray, acceptably comfortable.

In another embodiment the plies are made of nylon and the whole garment is stitched together. Crumbed polyether may be used instead of a sculptured cushion. The collar may instead be hollow and inflatable.

In use the garment is placed about the wearer's shoulders and the ties 12 secured. The wearer is seated adjacent the salon tray and the assistant guides the wearer's head rearwardly until the groove 18 engages the profiled edge 4 of the tray.

I have found the garment described in the embodiment to be comfortable to wear, easy to dry and keep clean and effective in operation.

I claim:

1. A collar positioned between a person's neck and the concave region of a salon neck tray profiled to accommodate a person's neck comprising (a) a waterproof flexible outer layer of sheet material (b) a cushioning inner layer configured to coact with the concave region of the salon neck tray when compressed by the wearer against said concave region so that the collar forms a fluid tight seal between the neck tray and the wearer's neck; and (c) means to fix the collar in an operative position.

2. A collar as claimed in claim 1 wherein the outer layer encloses the inner layer.

3. A collar as claimed in claim 2 wherein the inner layer is a preformed, resilient foam component.

4. A collar as claimed in claim 1 wherein the ends of the collar which meet beneath the wearer's chin are of tapered thickness.

5. A collar as claimed in claim 1 wherein the means to fix the collar in the operative position is a tie capable of securing the collar around the wearer's neck.

6. A collar as claimed in claim 1 wherein the opposite ends of the collar terminate in a pair of ties which are capable of being mutually joined in the region of the wearer's chin.

7. A collar as claimed in claim 1 wherein a cape is attached to the collar which in use covers the shoulders of the wearer.

8. A collar as claimed in claim 7 wherein the cape is substantially rectangular being of a width which exceeds the length of the collar.

9. A collar as claimed in claim 7 wherein the outer layer and the cape are made of the sheet plastics material.

10. A collar as claimed in claim 7 wherein the cape, the outer layer of the collar and the ties are made of a single sheet of material, the collar part of which is folded to form a tube which encloses the preformed component the ends of the tube being formed into ties of double thickness.

11. A collar positioned between a person's neck and the concave region of a salon neck tray profiled to accommodate a person's neck comprising (a) a waterproof flexible outer layer of sheet material, (b) a cushioning inner layer at least partially enclosed in said outer layer, (c) a longitudinal groove extending over sufficient length of said collar to permit most of the length of concave region of the tray to project into the groove to assist correct location of the collar in relation to the tray, and (d) means to fix the collar in an operative position.

12. A collar as claimed in claim 11 wherein the outer layer is made of a tube of weldable sheet material having front and rear faces and the groove is defined by a pair of parallel weld lines which join the front and rear faces of the tube.

13. A collar as claimed in any one of the preceding claims wherein the collar is of I-section having a pair of parallel ribs with a groove between the ribs.

* * * * *